US006047705A

United States Patent [19]

Hawley

[11] Patent Number: 6,047,705

[45] Date of Patent: Apr. 11, 2000

[54] HAIR STYLING APPARATUS

[76] Inventor: Anthony Arthur Hawley, 17 Lesser Foxholes, Shoreham by Sea, West Sussex BN43 5NT, United Kingdom

[21] Appl. No.: 09/147,158

[22] PCT Filed: Aug. 7, 1997

[86] PCT No.: PCT/GB97/02134

§ 371 Date: Oct. 21, 1998

§ 102(e) Date: Oct. 21, 1998

[87] PCT Pub. No.: WO98/06295

PCT Pub. Date: Feb. 19, 1998

[30] Foreign Application Priority Data

Aug. 9, 1996 [GB] United Kingdom ..... 9616722

[51] Int. Cl.[7] ..... A45D 24/04

[52] U.S. Cl. ..... 132/128; 132/275

[58] Field of Search ..... 132/128, 130, 132/127, 275; 2/171, 174; D28/32, 39, 41

[56] References Cited

U.S. PATENT DOCUMENTS

| | | | |
|---|---|---|---|
| D. 316,161 | 4/1991 | Kuglen | D28/41 |
| D. 334,793 | 4/1993 | Richardson . | |
| 966,113 | 8/1910 | McCall | D28/41 |
| 1,635,065 | 7/1927 | Watson | 132/128 |
| 1,693,168 | 11/1928 | Weller | 132/128 |
| 1,823,361 | 9/1931 | Hudson | 132/128 |
| 1,909,677 | 5/1933 | Hemmingson | 132/128 |
| 4,254,783 | 3/1981 | Kim . | |
| 5,174,312 | 12/1992 | Adams . | |
| 5,494,060 | 2/1996 | Potut . | |
| 5,690,128 | 11/1997 | Grimes | 132/128 |
| 5,732,720 | 3/1998 | Sears | 132/128 |

FOREIGN PATENT DOCUMENTS

| | | | |
|---|---|---|---|
| 319 203 | 11/1902 | France . | |
| 319 227 | 11/1902 | France . | |
| 372 085 | 3/1907 | France . | |
| 594 906 | 9/1925 | France . | |
| 205 861 | 1/1909 | Germany . | |
| 205861 | 1/1909 | Germany | 132/128 |
| 71791 | 5/1916 | Germany | 132/128 |
| 17403 | of 1889 | United Kingdom | 132/128 |
| 240 377 | 10/1925 | United Kingdom . | |
| 279 268 | 10/1927 | United Kingdom . | |
| 315 733 | 7/1929 | United Kingdom . | |
| 800 390 | 8/1958 | United Kingdom . | |

*Primary Examiner*—Todd E. Manahan
*Attorney, Agent, or Firm*—Bacon & Thomas, PLLC

[57] ABSTRACT

Hair styling apparatus comprising two combs (1) each having a curvilinear spine (4) and joined together by two or more elasticated material ties (2), each releasably connected to the spine of one or each comb by complementary interchanging means of the ties and the combs. In a preferred arrangement, three ties are provided, the connection points of these being substantially equi-spaced along the length of the respective spine.

4 Claims, 5 Drawing Sheets

HAIR STYLING APPARATUS

This invention relates to hair styling apparatus.

Presently, items such as hair grips, pins, scrunchies, elasticated bands and the like are used by ladies to style their hair and to keep the chosen style in place over a period of time. Decorative hair accessories are also sometimes used to enhance the selected style.

A device for waving hair is disclosed by GB-PS-240377. This device includes a pair of separable combs connected together by spring clips or rubber bands. The device is intended to be inserted in the hair whilst it is damp and allowed to remain in place until the hair is perfectly dry to create a waving effect. The spine of each comb of the device is straight, not curvilinear. Similar devices are illustrated in GB-PS-279268, U.S. Pat. No. 5,174,312 and U.S. Pat. No. 5,494,060. However, in each of these devices the connection between the comb-pieces is neither elasticated nor readily releasable.

The straight spines of the device of GB-PS-240377 limits the use of the device to the waving technique discussed above and the comb connections of the devices of the three other documents are cumbersome and inappropriate for day-to-day use.

The present invention sets out to provide styling apparatus which also acts as a decorative accessory and which overcomes or at least alleviates many of the problems discussed above.

According to the present invention in one aspect there is provided hair styling apparatus comprising two combs each having a curvilinear spine and joined together by two or more elasticated material ties each releasably connected to the spine of one or each comb by two or more spaced openings formed in the comb spine into which the ends of a like number of material ties locate for retention therein, the combs in use, being engaged in the hair with the elasticated ties stretched therebetween to constrain the hair to be styled.

In a preferred arrangement, three ties are provided, the connection points of these being substantially equi-spaced along the length of the respective spine.

The material ties are preferably decorative in nature.

Each opening may extend through the spine and may include inwardly extending protrusions shaped to impart resistance to withdrawal of an end of a material tie from the opening. The opening may be round, rectangular, elliptical or other shape. Alternatively each opening may include or be associated with a hook-shaped protrusion around which a looped end of a material tie or extension thereto can be retained. The extension may be elasticated.

Alternatively, a snap-on connector may be attachable to the or each comb spine, the respective tie ends being trapped between the opposed surfaces of the snap-on connector and the spine surface.

The connecting feature of each material tie may comprise a ball or barb of material, metal, plastics or the like, which is tied, crimped, fused or glued to one or each end of the material pieces. Other shaped members may be employed, e.g. conical or frustoconical member.

The invention will now be described by way of example only with reference to the accompanying diagrammatic drawings, in which.

Figure 1:
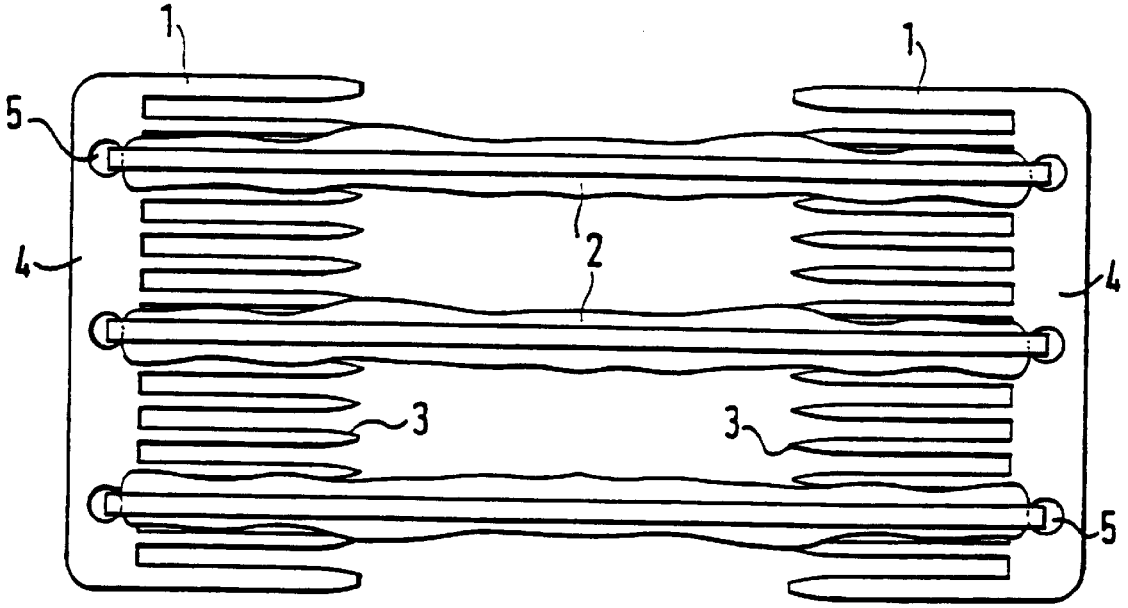
FIGS. 1 and 2 are respectively front and side views of hair styling apparatus in accordance with the invention.

As will be seen from FIG. 1, the illustrated hair styling apparatus comprises a pair of combs 1 joined together by three elasticated material ties 2 of substantially the same length. The ties 2 may be covered with or carry decorative material or features.

Figure 2:
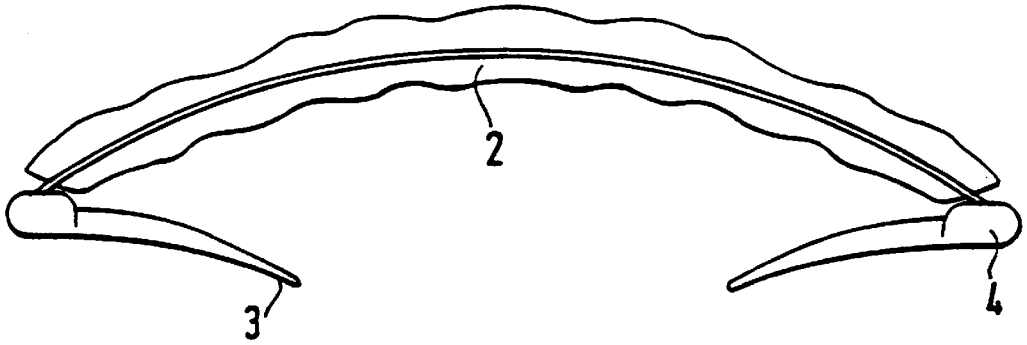

As will be seen from FIG. 2, the teeth 3 of each comb are curvilinear.

The comb spine 4 is also curvilinear.

The comb spines are releasably connected to tie ties by simple hand movement for ease of removal and replacement.

Figures 3, 4, 5:
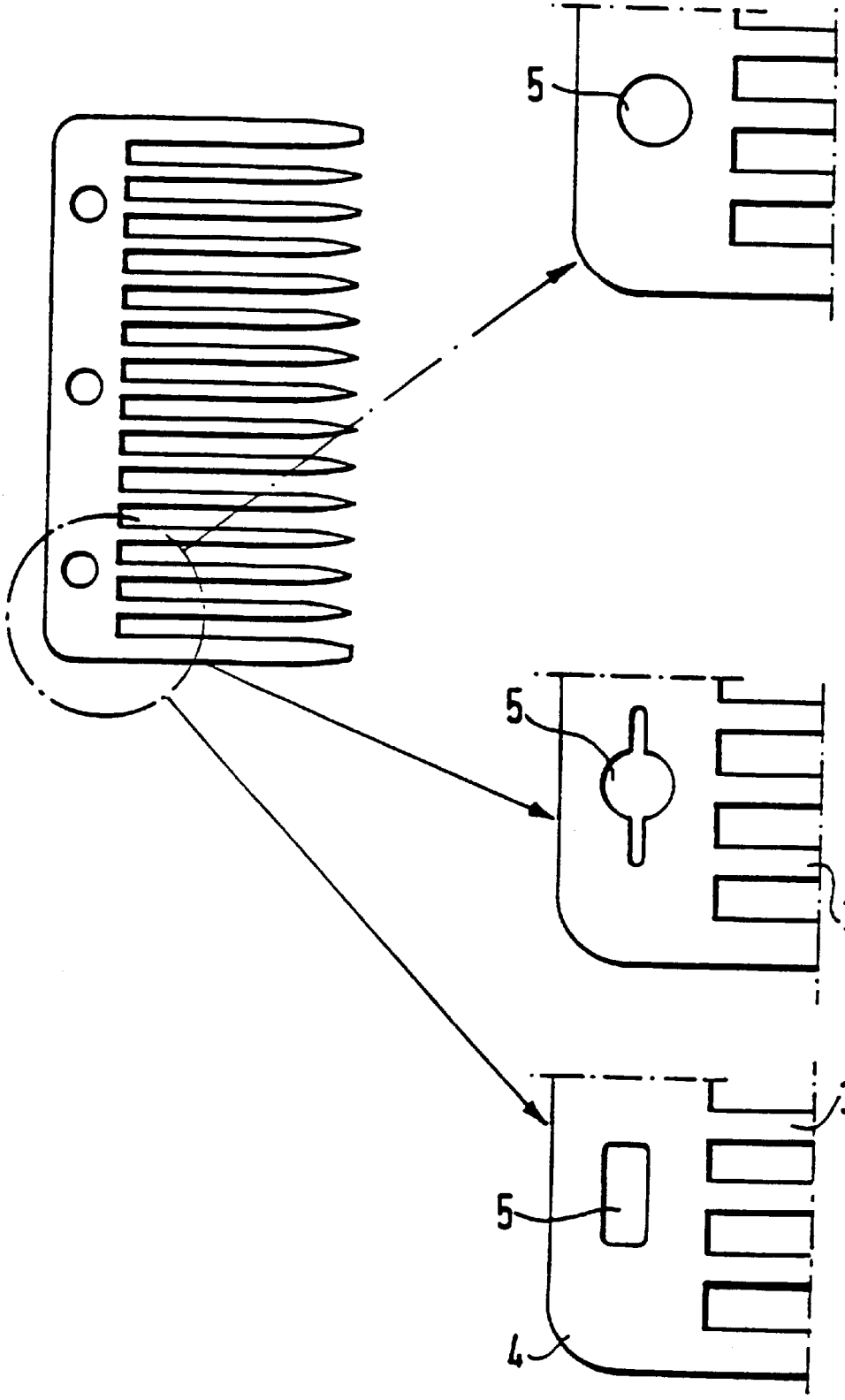
FIGS. 3 to 5 are details to an enlarged scale of connection features of apparatus in accordance with the invention.

To this end, each comb 1 has formed in its spine 4 three equally spaced through openings 5 into and through which ends of the ties 2 pass. As shown in FIGS. 3, 4 and 5, the shape of these openings may, for example be of round, keyhole or rectangular shape. Other suitable shapes could, however, be employed.

Figure 6:
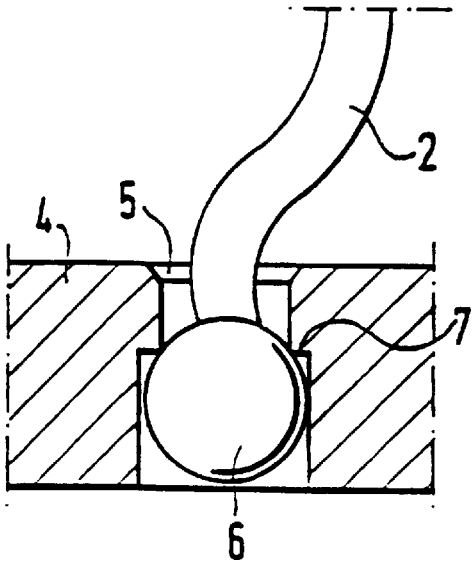
FIGS. 6 to 13 are sectional views taken through the spines of combs which form part of apparatus in accordance with the invention.
Figure 7:
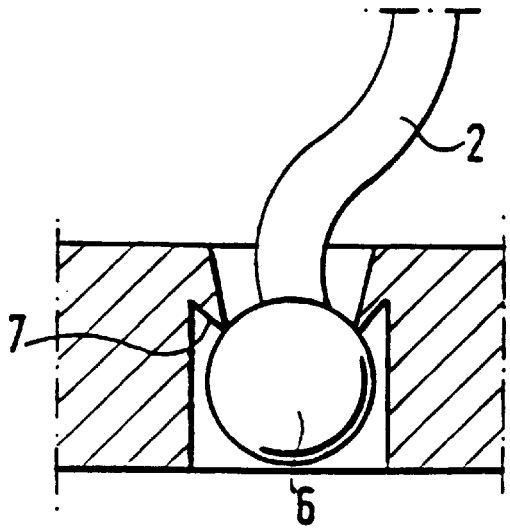
Figure 8:
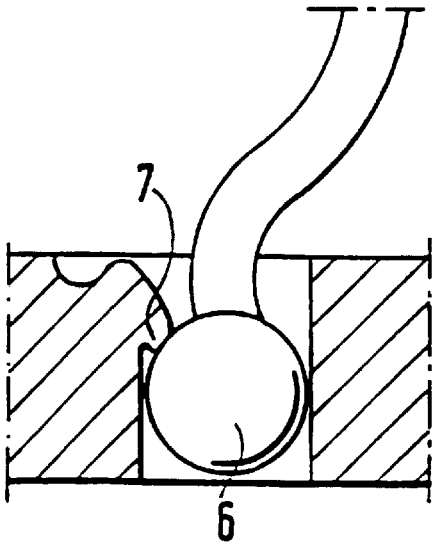
Figure 9:
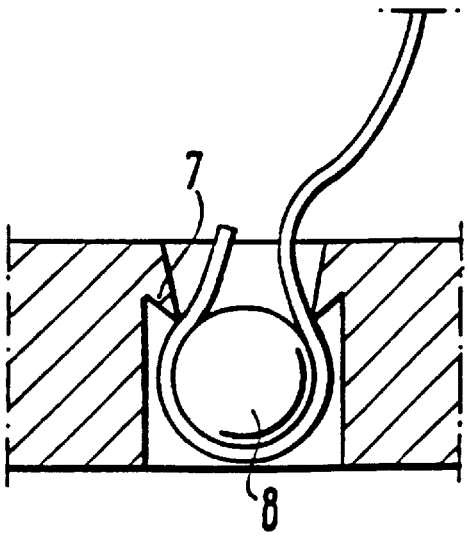

In cross section the openings may be inwardly stepped in the manner shown in FIGS. 6 to 9. Also, as shown in FIGS. 6 to 8, each tie 2 may have attached to one or each of its ends a material, metal or plastics barb or ball 6 which enters the respective opening 5 through its narrower end and is retained within the opening by engagement with the inwardly extending shoulders 7 of the steps. The balls may have sufficient flexibility to enable them to pass between the shoulders before expanding to the positions illustrated. Additionally, or alternatively, the shoulders may flex to enable the balls to pass therebetween. Thus, if a rigid plastics or metal ball is used, the material of the comb spine will have sufficient flexibility to enable the ball to pass through the respective opening. In an alternative construction, a knot is simply tied in each tie end to replicate the action of the illustrated ball. The balls 5 may be tied, crimped, fused or glued to the ends of the ties. Ribs may optionally be positioned along the axis of each opening to enhance retention of the balls within the openings. In the embodiment illustrated in FIG. 8, the opening is heat staked to enhance ball retention. In the arrangement shown in FIG. 9, a separate ball 8 is provided around which a tie end or an elastic extension to a tie is positioned.

Figure 10:
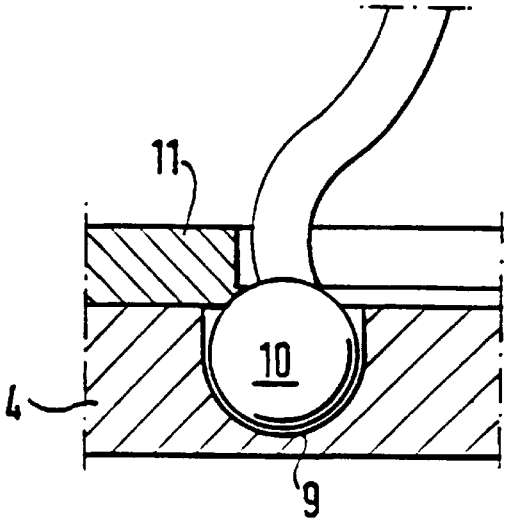

In the arrangement illustrated in FIG. 10, recesses 9 are formed along the spine 4 of one or both combs in each of which is received a ball 10 around which is wound one end of a tie or elasticated tie extension. Each ball 10 is retained in place by fittings 11 which snap-on, or are screwed, glued or riveted to the surface of each comb spine.

Figure 11:
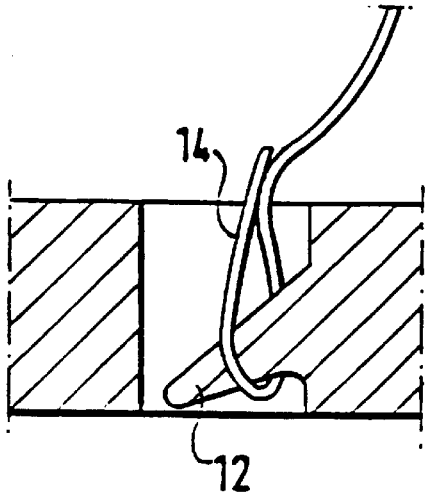
Figure 12:
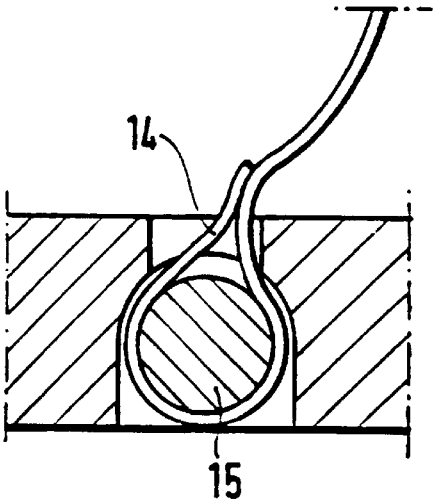

As shown in FIG. 11, each spine opening may included a hook-shaped protrusion 12 over which a looped end 14 of a tie or elasticated tie extension may locate. A similar construction is shown in FIG. 12 except that in this arrangement the hook-shaped protrusion 12 extends to a position below the opening.

Figure 13:
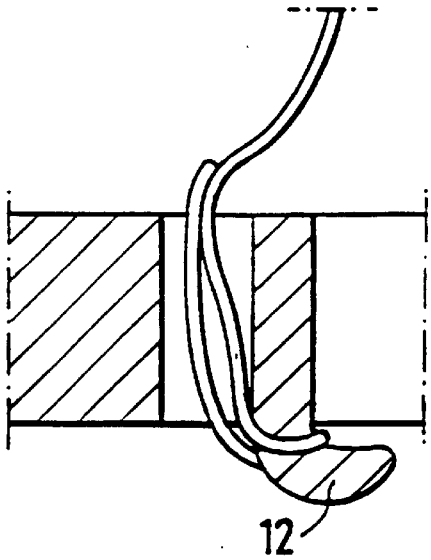
Figure 14:
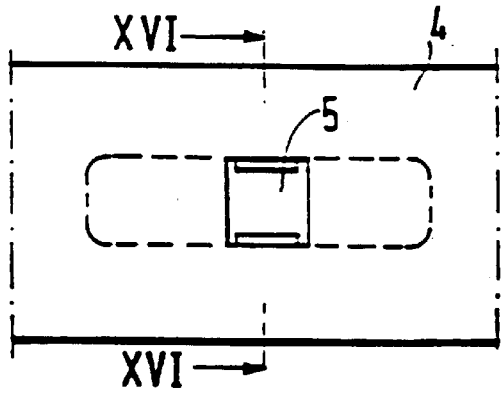
FIGS. 14 to 17 are respectively front, sectional and rear views of alternative apparatus in accordance with the invention.
Figure 15:
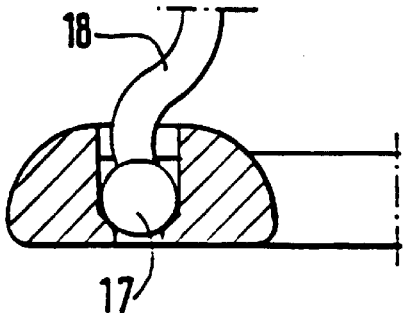
Figure 16:
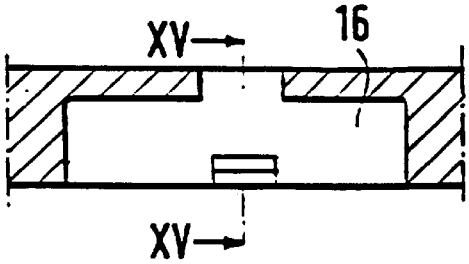
Figure 17:
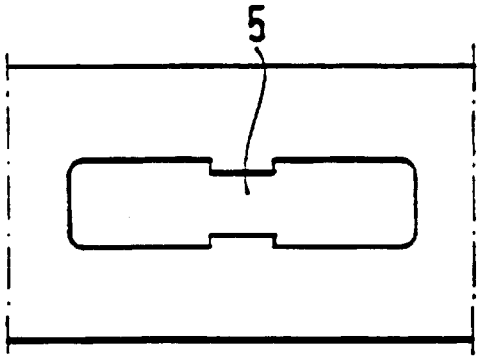
Figure 18:
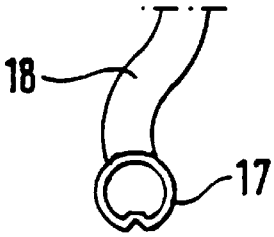
FIGS. 18 and 19 are respectively side and end views of a barbed extension piece forming part of apparatus in accordance with the invention.
Figure 19:
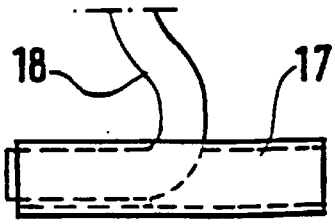

In the arrangement shown in FIG. 13, a looped tie end 14 or elasticated tie extension is trapped within the opening by a snap-in rod 15.

In the embodiment illustrated in FIGS. 14 to 17, the illustrated opening 3 is recessed on its undersurface to define a slot 16 to receive an elongate metal barb 17 secured by, for example, crimping to an elasticated extension 18 of a tie. In use, the barb is simply threaded through the opening 5 and then turned through 90° to seat within the slot 16.

It will be appreciated that other complementary connections can be employed.

The combs and ties can be produced in a wide range of colours. The ties may be decorative themselves or carry decorative pieces such as bows. The apparatus described enables the user to create a number of hair styles and provides a fashion accessory for the hair of the user.

In use, one comb is slid into the hair. The fingers of one hand are then placed over this comb and through the material ties to hold both the comb and the hair in place. The second comb is then reversed with the other hand and is slid into the hair such that the teeth ends of the combs lie next to one another with the hair held by the teeth of the comb in the selected style.

It will be appreciated that the foregoing is merely exemplary of hair styling apparatus in accordance with the invention and that modifications can readily be made thereto without departing from the true scope of the invention as set out in the appended claims.

What is claimed is:

1. A decorative hair device comprising:

two combs each having a curvilinear spine having a plurality of evenly spaced openings therein, the combs joined together by at least one elasticated material tie, the or each tie having a decorative coating thereon and opposite ends, connection means on one or both ends of each tie, said connection means being retained within one or more openings in one comb, such that said connection means does not extend beyond the surface of the comb, the combs, in use, being engaged in the hair with each elasticated tie stretched therebetween to constrain the hair to be decorated.

2. A device as claimed in claim 1, wherein each opening extends through the spine and includes inwardly extending protrusions shaped to impart resistance to withdrawal of the connection means at the end of the material tie, from the opening.

3. A device as claimed in claim 1, wherein each opening includes a hook-shaped protrusion around which the connection means at the end of a material tie can be connected.

4. Apparatus as claimed in claim 1 wherein the connection means comprises a ball or barb which is connected to one or both ends of each material tie.

* * * * *